US005218576A

United States Patent [19]

DeChico

[11] Patent Number: 5,218,576

[45] Date of Patent: Jun. 8, 1993

[54] UNDERWATER TRANSDUCER

[75] Inventor: Robert A. DeChico, Pennington, N.J.

[73] Assignee: The United States of America as represented by the Secretary of the Navy, Washington, D.C.

[21] Appl. No.: 887,983

[22] Filed: May 22, 1992

[51] Int. Cl.[5] ..... H04R 15/00

[52] U.S. Cl. ..... 367/171; 367/166

[58] Field of Search ..... 310/337; 367/155, 157, 367/160, 163-166, 171, 180

[56] References Cited

U.S. PATENT DOCUMENTS

| | | | |
|---|---|---|---|
| 4,184,093 | 1/1980 | Sullivan | 367/157 X |
| 4,694,440 | 9/1987 | Ogura et al. | 367/166 X |
| 4,705,981 | 11/1987 | Inoue et al. | 367/180 X |
| 4,709,361 | 11/1987 | Dahlstrom et al. | 367/165 |
| 4,803,671 | 2/1989 | Rochling et al. | 367/166 |
| 4,964,091 | 10/1990 | Cook | 367/165 |

*Primary Examiner*—Brian S. Steinberger
*Attorney, Agent, or Firm*—James V. Tura; James B. Bechtel; Susan E. Verona

[57] ABSTRACT

An underwater transducer comprises a piezoceramic transduction layer and a metal substrate with a thin film of viscous fluid between them. The viscous film allows the transduction layer and substrate to expand and contract relative to each other when the laminate bends under increasing hydrostatic pressure as the transducer descends in a body of water. At sonic frequencies, however, the viscous film provides effectively a rigid bond between the transduction layer and the substrate so that they vibrate in unison. The invention reduces hydrostatic compressive loading on the transduction layer and thereby improves performance in deep water applications. A ring on the substrate surrounds and is engaged by the edge of the transduction layer as hydrostatic pressure increases in order to apply enough compressive stress to the transduction layer to prevent peaks in dynamic loading from exceeding the tensile limits of the transduction layer. Electrical connections are made to the face of the transduction layer opposite the face exposed to the viscous film. Viscosity effects are improved by the use of flow restricting structures. The invention can be embodied in a double bender disc transducer.

12 Claims, 4 Drawing Sheets

Fig. 2
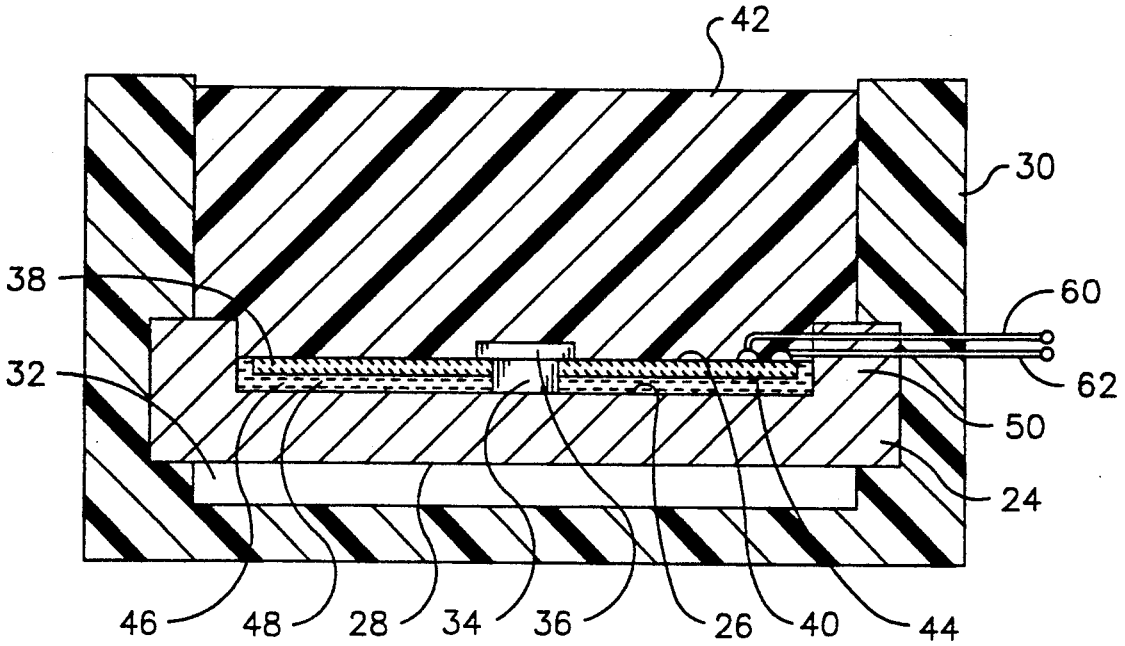
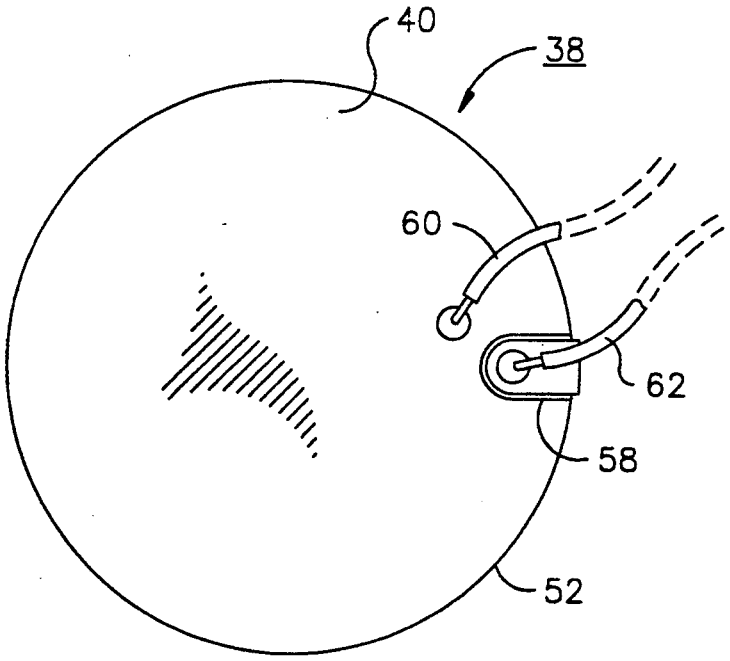
Fig. 3
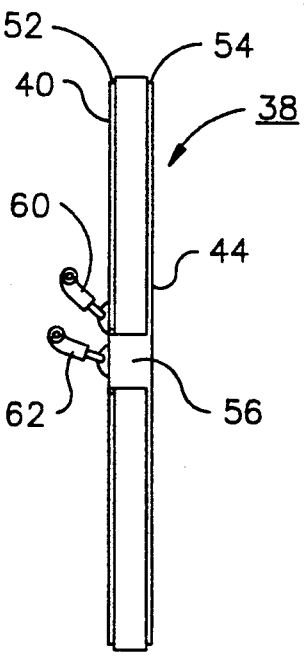
Fig. 4

*Fig. 5*
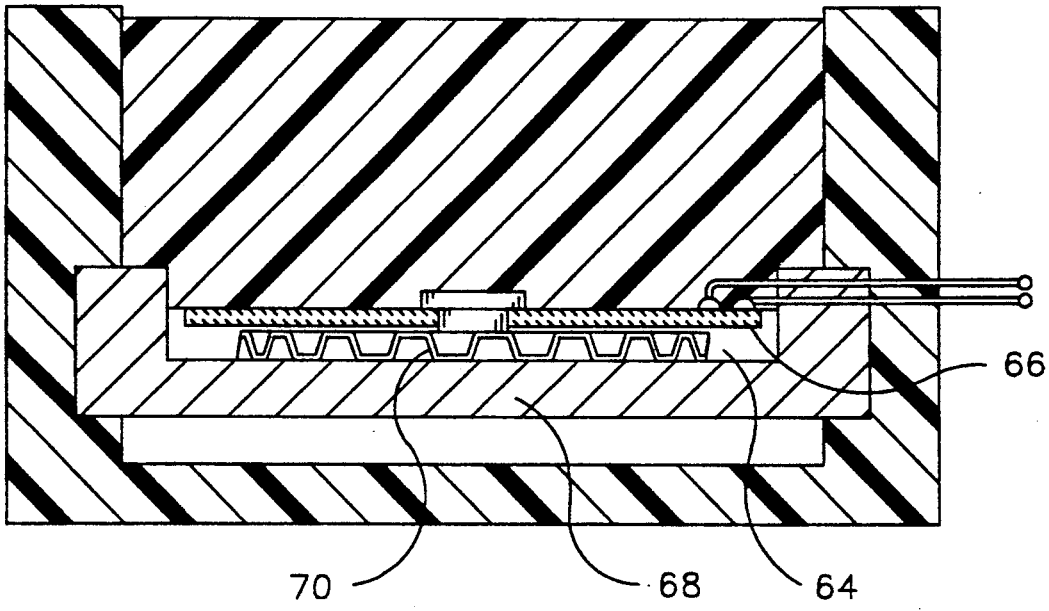
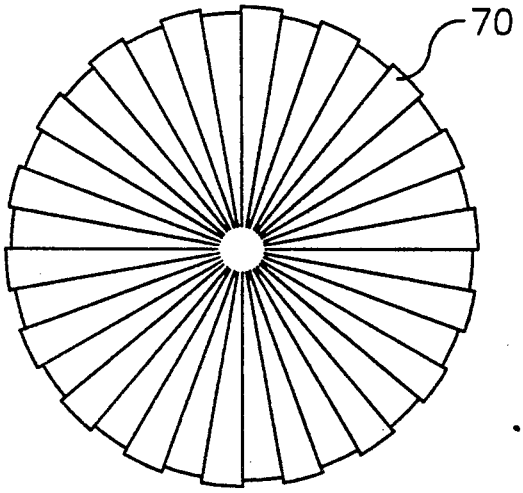
*Fig. 6*

UNDERWATER TRANSDUCER

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION

This invention relates to underwater transducers, and more particularly to improvements in projectors and hydrophones of the flexural type, in which a layer of active transduction material, such as piezoceramic or rare earth magnetostrictive material, is bonded to a passive substrate material, for example brass or steel, which serves as a structural support for the active transduction material.

In a typical flexural underwater transducer, the active layer is coupled to the surrounding water through a sound-conducting material, while the substrate is backed by an enclosed gas, usually air. The active transduction layer is permanently fixed to the substrate by a bonding material such as high strength epoxy. Because the active layer is fixed to the substrate, the bonded pair of layers, when flexed, have a single neutral plane, i.e. an internal plane on one side of which the materials are in compression and on the other side of which the materials are in tension. Since the substrate is ordinarily stiffer than the active layer, the neutral plane is located within the substrate layer.

When the pair of layers is bent, by hydrostatic pressure, in such a way that the face of the active layer which is coupled to the surrounding water is concave, the active layer is in compression, while the substrate is partly in compression and partly in tension.

The active layer is capable of withstanding a limited amount of compressive stress, e.g. up to 30,000 psi in the case of a piezoceramic, but very little tensile stress. In the case of piezoceramic active layer, tensile stresses greater than about 1000 psi are likely to cause damage.

The acoustic performance of the active layer tends to degrade with increasing compressive stress. Therefore, ideally, the compressive stress in the active material should be only enough to compensate for dynamically induced stress. In the case of a projector, the compressive stress should only be enough to prevent the peaks in the sinusoidal dynamic stress, induced in the material by the electrical driving signal, from exceeding the tensile limit. In a hydrophone, the compressive stress in the active layer, caused by static pressure, adversely affects its piezoelectric parameters. In addition, over time, compressive stress causes aging degradation. Thus, the compressive stress in the active layer should be limited to an amount less than that which will cause the active material to degrade in sensitivity. In a conventional flexural transducer in which the transduction material is bonded to the substrate, it has been generally necessary to place the transduction layer under more compressive stress than was desirable, at least in deep water applications.

The design of a typical flexural transducer, therefore, is a compromise between mechanical ruggedness and acoustic performance.

Another problem with typical flexural transducers, and in particular electrically driven projectors, is that, in some cases, their active transduction layers are prestressed in compression. The reason for this is to prevent peaks of a large-magnitude electrical driving signal from driving the material into excessive tension, i.e. more than 1000 psi. The built-in compressive stress in the active layer tends to degrade the acoustic properties of the device over time. Therefore, in the case of a device which typically has a long shelf life before usage, degradation of performance can occur even before the device is placed into service.

Another problem in typical flexural transducers is that differential thermal expansion and contraction of the bonded active and passive layers can cause shear stresses in the layers.

Where non-metallic passive layers, formed of materials such as glass fiber or graphite composites, are used, they are typically prestressed in order to insure proper operation when submerged to operating depths. The prestressing of the non-metallic layer can cause material creep, which can have a detrimental effect on the mechanical relationship between the rigidly bonded active and passive layers.

SUMMARY OF THE INVENTION

The principal object of this invention is to relax design constraints and thereby provide for more effective optimization of the design of a flexural underwater transducer. Other objects include: reducing hydrostatic stress on the active transduction components; achieving improved acoustic performance; providing a capability of operation at greater depths; reducing degradation of performance with age; avoiding detrimental effects of differential thermal expansion and contraction; and avoiding detrimental effects of material creep.

In accordance with the invention, the foregoing objects are addressed in a transducer comprising an active transduction layer and a substrate, by providing a thin layer of viscous fluid between the transduction layer and the substrate. The viscous layer allows slow relative expansion of the transduction layer and the substrate so that hydrostatic stress on the transduction layer is reduced. At sonic frequencies, however, the viscous layer couples the transduction layer to the substrate so that they vibrate in unison.

Further objects, advantages and novel features of the invention will become apparent from the following detailed description of the invention when considered in conjunction with the accompanying drawings wherein:

BRIEF DESCRIPTION OF THE DRAWINGS

FIG. 2 is a similar sectional view of a flexural transducer in accordance with a first embodiment of the invention;

FIG. 3 is a top plan view of the active transduction layer of the transducer of FIG. 2, showing the electrical connections to the active layer;

FIG. 4 is a right side elevational view of the active transduction layer as shown in FIG. 3;

FIG. 5 is a sectional view of a flexural transducer in accordance with a second embodiment of the invention;

FIG. 6 is a plan view of a corrugated disc used as a flow restrictor in the transducer of FIG. 5.

DESCRIPTION OF THE PREFERRED EMBODIMENT

Figure 1:
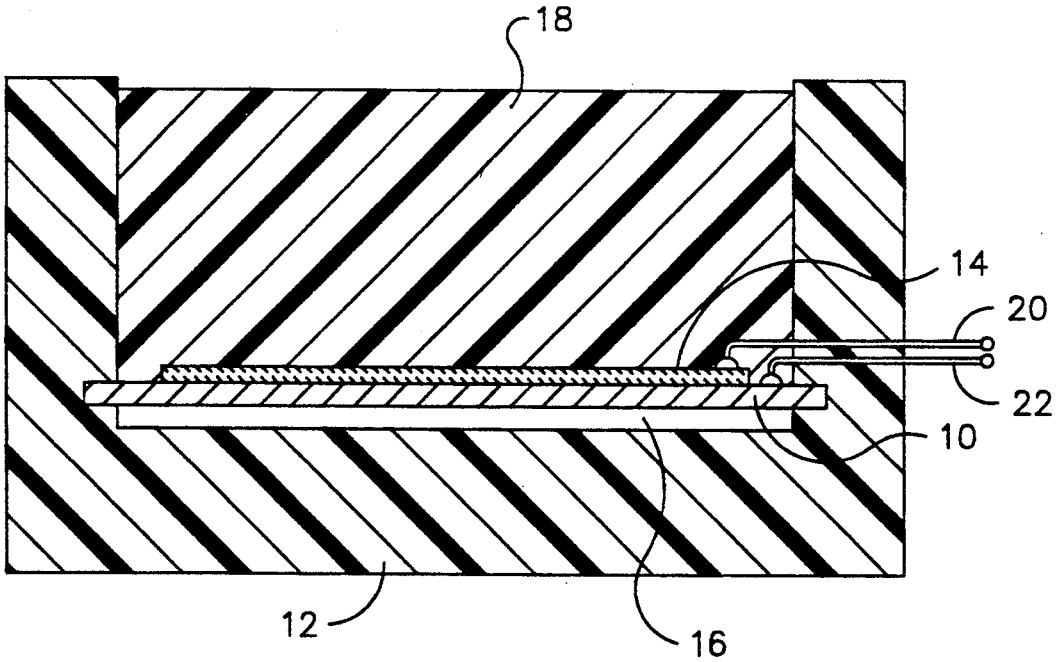
Fig. 1 (Prior Art)
FIG. 1 is a sectional view of a typical flexural transducer in accordance with the prior art.

In a typical conventional underwater flexural transducer, as shown in FIG. 1, a substrate disc 10, typically of brass or steel, is supported in a plastic encapsulating housing 12, typically of molded polyurethane. An active transduction layer 14, typically a piezoceramic material, formed from a Lead titanate zirconate, is rigidly bonded, by an epoxy bonding adhesive, to one face of the substrate. An air chamber 16, underneath the substrate, is enclosed by a plate 17, separated from substrate 10 by a ring 18. The transduction layer is mechanically coupled, through the encapsulating plastic, to the surrounding body of water (not shown).

The device of FIG. 1 can be used either as a projector (to generate sounds when driven by an alternating electrical signal), or as a hydrophone (to produce electrical signals corresponding to detected underwater sounds). The tranduction layer is ordinarily metal-plated on both faces. In the case of a projector, the metal plating enables the required electric field to be established in the transduction layer. In the case of a hydrophone, the metal plating enables the electric field generated by stress in the active layer to be translated into a current. Electrical connections are made to the metal plating as shown in FIG. 1. A first electrical lead 20 is connected to the upper face of layer 14, and a second electrical lead 22 is connected directly to substrate 10, which is in contact with the lower face of layer 14.

Whether the device of FIG. 1 is used as a projector, or as a hydrophone, when the device is submerged, hydrostatic pressure acting on the exterior of the housing, exerts a force, through the plastic encapsulating housing 12, which tends to bend layers 14 and 10 so that the upper face of layer 14 is concave.

Because the two layers are rigidly bonded together, they bend together and have only one neutral plane. Of the two layers, substrate layer 10 ordinarily has the greater stiffness. Consequently, the neutral plane is located within the substrate layer. This means that the application of hydrostatic pressure places transduction layer 14 in compression, and that the compression in layer 14 increases with increasing depth of submersion. As mentioned above, it is necessary to maintain some compression in the transduction layer to prevent it from being electrically or mechanically driven into tension exceeding a very low limit, e.g. 1000 psi. However, excessive compression causes the acoustic performance of the device to deteriorate.

In the device of FIG. 2, a metal substrate layer 24, having a first face 26 and a second face 28, is supported in a plastic housing 30 in such a way as to provide an enclosed gas space 32. A plastic stud 34, having a head 36, extends upward from substrate layer 24. A disc-shaped active transduction layer, e.g. a piezoceramic layer, has a central hole receiving stud 34 and is cemented to head 36 of the stud. Layer 38 is therefore held with its first face 40 in contact with plastic coupling layer 42, and with its second face 44 in parallel, spaced relationship with first face 26 of substrate 24.

The spacing 46 between faces 26 and 44 is exaggerated in FIG. 2 for the sake of illustration. In actuality, the space will be only on the order of 0.025 mm., i.e. just enough to accommodate a thin film 48 of viscous fluid. This thin film of fluid allows substrate 24 and transduction layer 38 to expand and contract, relative to each other, in directions parallel to their faces, as they bend under hydrostatic pressure applied to layer 38 through coupling layer 42. It allows each of layers 24 and 38 to have its own neutral plane. Thus, as the transducer is submerged in a body of water, hydrostatic pressure will cause layer 38 to bend, but its compression, in directions parallel to its faces, will be much less than it would be if it were rigidly bonded to substrate layer 24.

Despite the fact that the film of viscous fluid allows relative expansion and contraction of layers 24 and 38 as hydrostatic pressure slowly changes, it provides what is essentially a rigid bond between the two layers at sonic frequencies, so that the device can operate effectively as a transducer.

The term "viscous fluid" as used herein includes not only liquids but also materials which are usually regarded as solids but which have a tendency to behave like highly viscous liquids when subjected to mechanical stress.

A wide variety of viscous fluids can be used as film 48. For example, a high viscosity material known as "Melt Mount", used for microscope slides, is suitable. This material is available from R. P. Cargille Laboratories, Inc., of Cedar Grove, N.J. Immersion oils comprising a hydrogenated terphenyl in combination with mineral oil and/or polybutene derivatives, such as those described in U.S. Pat. No. 3,929,667, issued Dec. 30, 1975, can also be used.

Other materials can be used, including electrorheological fluids, e.g. corn starch in corn oil, which change viscosity and bulk modulus as a function of the applied electric field, and ferrofluidic materials (also known as "magnetic liquids"), which change viscosity and bulk modulus as a function of the applied magnetic field. Viscosity of a typical magnetic fluid ranges from between 0 and 10 centistokes at 0 gauss to 700 centistokes at 700 gauss. The viscosity range of a magnetic fluid, of course, depends to a large extent on the viscosity of the base fluid. Base fluids can have viscosities up to, and even higher than, 7500 centistokes, with applied magnetic field.

Waxes and putty can also be used, as can synthetic resins which exhibit "creep".

In all cases, the viscosity of the fluid should be high enough to insure that the active and passive layers are effectively bonded rigidly together at sonic frequencies, i.e. 20 Hz. to 20 Khz., but not so high as to prevent relative expansion of the adjacent active and passive layers over the time interval required for the transducer to descend to its operating depth, usually on the order of several seconds to several minutes. In the case of a hydrophone, shear strength of the fluid is relatively unimportant. However, in the case of a projector, the shear strength of the fluid should be high, e.g. greater than around 5000 psi. Preferably, the fluid should not exhibit significant changes of viscosity with temperature over the range of ocean temperatures likely to be encountered.

Substrate 24 is cup-shaped, having an annular wall 50 extending upward from its upper face near its periphery. Wall 50 surrounds transduction layer 38 and is slightly spaced from the periphery of the transduction layer when the device is under atmospheric pressure. When the device is submerged beyond a given depth, bending of layers 24 and 38 under hydrostatic pressure will cause the periphery of layer 38 to come into contact with wall 50. Further bending will then cause the neutral plane of layer 38 to move into layer 24, thus subjecting layer 38 to a limited amount of compressive stress.

The compressive stress applied hydrostatically at operating depth can be limited to the amount necessary to insure against excessive tensile stress in layer 38 resulting either from hydrostatic forces or from electrically induced dynamic forces. As the transducer descends toward its operating depth, the active layer 38 flexes independently of substrate 24. That is, the active layer has its own neutral plane. Assuming that the limit of tensile stress in the active layer is 1000 psi, the periphery of layer 38 must rigidly abut wall 50 before the 1000 psi tensile stress limit is reached. A projector has the additional constraint that, when at operating depth, it must be compressively biased so that, when dynamically driven, its peak tensile stress will not exceed the 1000 psi limit. By providing an appropriate spacing between the periphery of layer 38 and wall 50 under atmospheric pressure conditions, tensile stress in the active layer can be maintained below the 1000 psi limit without subjecting the active layer to excessive compressive stress.

When the transducer is to be used as a projector, its electrical driving signal should not be applied until the transducer reaches its operating depth. If driven before it reaches its operating depth, the transduction layer may fail due to excessive tensile stress.

To insure that the transduction layer and the substrate are, in effect, rigidly bonded together at sonic frequencies, it is necessary to use a very thin film of viscous fluid. Because of the presence of the fluid, it is no longer possible to make an electrical connection to the transduction layer through the substrate as in FIG. 1. Furthermore, the extremely narrow space between the second face 44 of the transduction layer and the first face 26 of the substrate, makes it difficult, if not impossible, to make a direct solder connection to face 44. This problem is addressed by constructing the transduction layer 38 as shown in FIGS. 3 and 4. An electrically conductive metallic plating, typically silver, is provided at 52 on face 40 and another, similar electrically conductive plating is provided at 54 on face 44. The plating on face 54 extends around the edge of layer 38, as shown in FIG. 4 at 56, and into a gap 58 in the plating 54 on face 40, as shown in FIG. 3. The extension makes it possible to connect both electrical leads 60 and 62 to face 40, as shown in FIGS. 2, 3 and 4.

To improve effective bonding of layers 24 and 38 to each other through the viscous fluid at sonic frequencies, faces of 26 and 44 can be "textured", e.g. roughened by sand blasting, or provided with channels cut in their surfaces.

In the alternative embodiment shown in FIGS. 5 and 6, effectiveness of the viscous fluid at sonic frequencies is improved by providing a layer of material which provides restricted channels for the flow of the fluid. In this case, within space 64, between active transduction layer 66 and passive substrate 68, a corrugated disc 70 is provided. This disc provides narrow radial channels for the flow of viscous fluid in space 64, and effectively increases the viscosity of the fluid. Thus, with the corrugated disc, space 64 can be larger than the narrow space 46 in FIG. 2, and the actual viscosity of the fluid can be less than that of the fluid used in the embodiment of FIG. 2. Other materials providing restricted channels can be used. For example, expanded metal layers can be cemented to the opposing faces of the transduction and substrate layers to provide restricted channels for the flow of viscous fluid.

Figure 7:
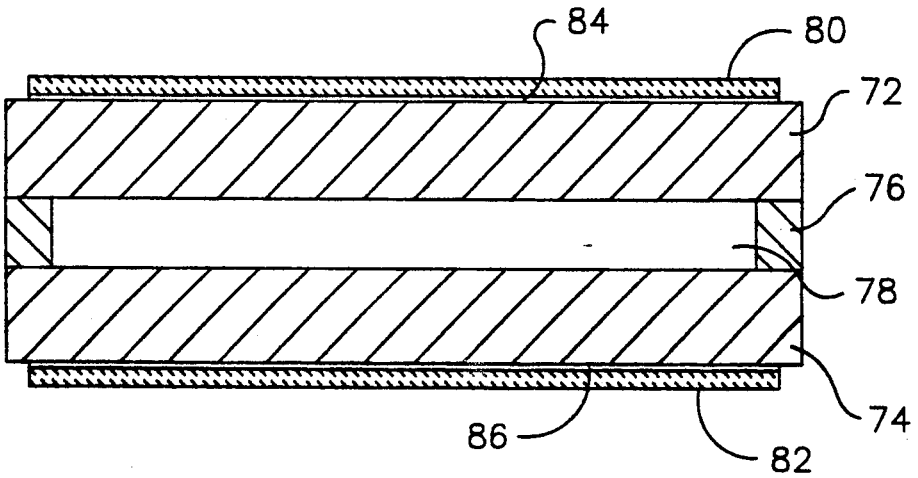
FIG. 7 is a schematic sectional view of a double transducer having a single air cavity, made in accordance with a third embodiment of the invention.

The embodiment of FIG. 7 is a bidirectional transducer and comprises a pair of substrate layers 72 and 74 spaced from each other by a metal ring 76 to provide an enclosed gas space 78. A first active transduction layer 80 is provided above substrate layer 72 and a second active transduction layer 82 is provided below substrate layer 74. Layer 80 is separated from layer 72 by a thin film 84 of viscous fluid, and layer 82 is similarly separated from layer 74 by a thin film 86 of viscous fluid. Electrical connections and mountings for the active transduction layers are omitted in FIG. 7, but can be similar to those shown in FIGS. 2–4. The configuration of FIG. 7 can be embodied in an underwater acoustic projector as well as in a hydrophone.

The invention can be used in may applications, both commercial and military, where flexural transducers are operated under hydrostatic loads. Examples of applications include sonar systems and apparatus for oil exploration. The invention provides significantly improved performance especially under high hydrostatic loads incurred at depths approaching 1000 feet or more, since it reduces the hydrostatic stress on the transduction layer which would ordinarily be incurred at these depths.

The invention is applicable not only to "bender disc" transducers of the kind specifically described herein, but also to other forms of flexural transducers utilizing the flexing of laminates of transduction material and substrate material. For example, the invention is applicable to slotted cylinder transducers in which the substrate is in the form of a tube having cylindrical inner and outer walls and a longitudinal slot, and the active layer is a piezoceramic layer lining the interior wall of the substrate.

Modifications other than those set forth above will occur to persons skilled in the art, and it is therefore to be understood that within the scope of the appended claims, the invention may be practiced otherwise than as specifically described.

I claim:

1. A transducer for underwater use comprising a laminate consisting of means, comprising a first layer of material, for effecting a conversion between mechanical motion and an electrical signal, a passive substrate layer and bonding means between said first layer and said substrate layer, said bonding means comprising a thin layer of viscous fluid material, between said first layer and said substrate layer, for rigidly coupling said first layer and said substrate layer together at sonic frequencies whereby said first and substrate layers vibrate in unison, but allowing said first layer and said substrate layer to slip relative to each other in directions parallel to their faces as the laminate is flexed under increasing hydrostatic pressure as the transducer descends in a body of water, whereby shear stresses imparted to said first layer by hydrostatically induced bending of said substrate layer are substantially eliminated at operating depths.

2. A transducer for underwater use comprising, in combination:

means, comprising a first layer of material, for effecting a conversion between mechanical motion and an electrical signal, said first layer having opposite first and second faces;

a passive substrate layer, also having first and second faces, underlying the second face of the first layer; and means, located between the first face of the substrate layer and the second face of the first layer, bonding the first layer to the substrate layer, whereby each layer tends to bend when the other bends under dynamic stress at sonic frequencies;

said bonding means comprising a thin layer of viscous fluid between the second face of the first layer and the substrate, said bonding means allowing relative slippage of the layers as the transducer descents in a body of water, whereby shear stress imparted to the first layer by hydrostatically induced bending of the substrate layer is substantially eliminated at operating depths, while causing the layers to flex in unison at sonic frequencies.

3. A transducer according to claim 2 in which, at least within a range of depths extending from the surface of a body of water downward, and in the absence of dynamic stresses, each of the two layers has a neutral plane located between its first and second faces.

4. A transducer according to claim 2 having means for limiting expansion of said first layer in directions parallel to said opposite first and second faces, whereby, when the layers are flexed beyond a predetermined limit by hydrostatic pressure, the neutral plane of said first layer is located between the first and second faces of the substrate layer.

5. A transducer according to claim 4 in which said first layer has a peripheral edge, and in which said expansion limiting means is a stop fixed to the substrate layer and engageable by the peripheral edge of the first layer when said layers are flexed beyond said predetermined limit.

6. A transducer according to claim 4 in which said first layer is a disc-shaped layer having a circular peripheral edge, and in which said expansion limiting means is a stop fixed to the substrate layer and engageable radially by said circular peripheral edge of the first layer when said layers are flexed beyond said predetermined limit.

7. A transducer according to claim 4 in which said first layer has a peripheral edge, and in which said expansion limiting means is a stop unitary with the substrate layer and engageable by the peripheral edge of the first layer when said layers are flexed beyond said predetermined limit.

8. A transducer according to claim 2 including restricting means, located between the first face of the substrate layer and the second face of the first layer, for allowing restricted flow of said viscous fluid in directions parallel to said faces of the first and substrate layers, thereby increasing the mechanical coupling of the first layer to the substrate layer at sonic frequencies.

9. A transducer according to claim 8 in which said restricting means is a corrugated disc.

10. A transducer according to claim 2 in which said first layer comprises a layer of electrical-to-mechanical transduction material, a first electrically conductive coating forming at least part of the first face of said first layer and a second electrically conductive coating forming at least part of the second face of said first layer, said first electrically conductive coating having a gap near the periphery of said layer of transduction material, said second electrically conductive coating extending around the periphery of said layer of transduction material and having a portion extending into said gap, and having electrical connection leads bonded to said first coating on said first face and to said portion of the second coating on said first face, whereby said second face of the first layer can be in close proximity to said first face of the substrate layer.

11. A transducer for underwater use comprising, in combination:

means, comprising at least one layer of electrical-to-mechanical transduction material having first and second opposite faces, for effecting a conversion between mechanical motion and an electrical signal;

at least one passive substrate layer adjacent to each layer of electrical-to-mechanical transduction material, said passive substrate layer also having first and second faces;

means for enclosing a quantity of gas adjacent to the second face of each passive substrate layer;

means, located between the first face of each substrate layer and the second face of the layer of electrical-to-mechanical transduction material to which the last-mentioned substrate layer is adjacent, and bonding the adjacent layers together, whereby each of the adjacent layers tends to bend when the other bends under dynamic stress at sonic frequencies;

said bonding means comprising a thin layer of viscous fluid between the second face of the each layer of electrical-to-mechanical transduction material and the first face of its adjacent substrate layer, said viscous layer allowing relative slippage of the adjacent layers as the transducer descends in a body of water, whereby shear stresses imparted to the layers of electrical-to-mechanical transduction material by hydrostatically induced bending of the substrate layers are substantially eliminated at operating depths, while causing the adjacent layers to flex in unison at sonic frequencies.

12. A transducer according to claim 11 comprising a first layer of electrical-to-mechanical transduction material, a first passive substrate layer adjacent to said first layer of electrical-to-mechanical transduction material, a second layer of electrical-to-mechanical transduction material, and a second passive substrate layer adjacent to said second layer of electrical-to-mechanical transduction material, wherein the second faces of the passive substrate layers face each other and are spaced from each other by an annular spacer, and wherein said annular spacer and said substrate layers enclose said quantity of gas.

* * * * *